United States Patent [19]

House et al.

[11] Patent Number: 4,964,750

[45] Date of Patent: Oct. 23, 1990

[54] TRAFFIC BARRIER AND METHOD OF CONSTRUCTION

[75] Inventors: Randall House; Jesse Covarrubias, both of San Antonio, Tex.

[73] Assignee: Randall House, San Antonio, Tex.

[21] Appl. No.: 347,482

[22] Filed: May 4, 1989

[51] Int. Cl.[5] ..... E01F 13/00

[52] U.S. Cl. ..... 404/6; 404/70; 404/74

[58] Field of Search ..... 404/6, 7, 70, 72, 74; 256/1, 13.1; 52/102, 259, 436, 438, 439, 442, 583, 587

[56] References Cited

U.S. PATENT DOCUMENTS 4,494,892 1/1985 Wojciechowski ..... 404/6

4,605,336 8/1986 Slaw, Sr. ..... 404/6

*Primary Examiner*—Bruce M. Kisliuk

*Assistant Examiner*—Matthew Smith

*Attorney, Agent, or Firm*—Gunn, Lee & Miller

[57] ABSTRACT

This invention relates to a pre-cast concrete traffic barrier element and a method of constructing a traffic barrier using the element on a vertical face of a retaining wall. The barrier element is a profiled reinforced block of concrete having a bottom surface with a longitudinally extending channel therein. The traffic barrier element is supported on the retaining wall with a top surface of the retaining wall being received within the channel. U-shaped anchoring bars project from an interior portion of the traffic barrier element and from the top surface of the retaining wall to form an oval keyway the length of the longitudinal channel. A locking bar arrangement is inserted through the keyway in a locking relationship with the U-shaped anchoring bars. Sealing material between the traffic barrier element and the retaining wall and between the traffic barrier element and the ground adjacent to the retaining wall on the traffic side prevents the leakage of grout and leveling of the barrier element. Grout is then injected throughout the longitudinal channel and allowed to harden, thus providing a sealed and locked joint.

8 Claims, 3 Drawing Sheets

TRAFFIC BARRIER AND METHOD OF CONSTRUCTION

BACKGROUND OF THE INVENTION

1. FIELD OF THE INVENTION

This invention relates to pre-cast traffic barriers for use in highway construction More specifically, the present invention relates to a pre-cast concrete traffic barrier and a method of constructing a traffic barrier on the top face of a retaining wall or other supportive horizontal beam.

Traffic barriers are used on roads to keep a moving vehicle from crossing into the path of oncoming traffic or from driving off the roadway. The traffic barrier is especially useful on elevated or split-level roadways, such as bridges, entrance ramps, or access roads to highways, to prevent a vehicle from driving off the road onto a lower level roadway. These elevated roads are often formed by cutting through a hill or by piling earth or soil onto metal reinforcements to form a laterally stabilized composite earth structure to support the road. Either method of construction may result in a wall face which needs to be supported by a retaining wall. If this retaining wall is close to the road surface there is a need for a traffic barrier which can be anchored on top of the retaining wall. The wall, of any height, defines a lengthwise horizontal beam for anchoring the barrier.

Construction of a traffic barrier on top of and along a retaining wall may be cast-in-place so as to be an integral part of the retaining wall. However, this construction method requires forms to be constructed by workmen on scaffolding. Hand construction of the forms and pouring of concrete is slow and labor intensive Thus, there is a need for a more efficient method of constructing a traffic barrier onto the top face of a retaining wall.

2. DESCRIPTION OF THE PRIOR ART

Basic traffic barriers separating two lines of vehicular traffic are not new in the art. U.S. Pat. No. 3,678,815 issued to Younker discloses a concrete traffic barrier which may be used in forming bridge guard rails, median barriers, and the like. The Younker barrier includes a pair of identically shaped shells which are bolted together leaving a void into which concrete is poured to form a core of solid material. U.S. Pat. No. 4,435,106 issued to Forster et al. discloses a traffic barrier which may be used to separate a roadway. The Forster traffic barrier may be cast-in-place through the use of forms to construct a solid concrete barrier which rises from the roadway edge outwardly first gently and then more strongly and then spaced below an overhanging guiding mechanism. A steep convex rise follows the gentle rise and transfers under the guiding mechanism into a flattened area.

Combining steel and concrete in a traffic barrier was disclosed in U.S. Pat. No. 4,496,264 issued to Casey. Casey discloses a barrier structure comprised of a number of spaced apart inline vertical I-beam sections embedded in a roadway and having secured to the I-beams a number of form plates having a pair of downwardly and outwardly diverging pair of legs and a pair of upwardly diverging extending arms. Reinforcing rods are extended through aligned holes in the plates and side panels are connected to the panels. Concrete is poured down through the open top of the structure completely encasing the I-beams, panels, and reinforcing rods. The concrete bonds the side panels and a capping piece is pressed down into the concrete to form the steel and concrete traffic barrier.

Constructing concrete traffic barriers with pre-cast concrete was first patented by Smith in U.S. Pat. No. 4,059,362. Smith discloses a highway traffic barrier composed of pre-cast, reinforced concrete barricades which are joined together. The alignment with each barricade is accomplished through the use of a horizontally and vertically tapered, vertical tongue-and-groove arrangement. This tongue-in-groove arrangement is molded onto the ends of each barricade with the wider portion of the taper at the bottom to facilitate the removal of one piece of the traffic barrier within an installation. The Smith barricade though is designed to be a highway median barrier and cannot be secured to a retaining wall.

A pre-cast barrier design which can be used on retaining walls is disclosed in U.S. Pat. No. 4,494,892 issued to Wojciechowski This design makes use of an interior channel of the barrier which directly contacts the top edge of the retaining wall. The projecting anchoring rods extend either transversely into a lateral pre-cast concrete apron under the roadway surface or downwardly into the earthen support of the roadway. These projecting anchoring rods provide external support of the traffic barrier which is lacking in the original barrier element. The anchoring rods provide the support to withstand impacts from moving vehicles.

Another known pre-cast traffic barrier is U.S. Pat. No. 4,348,133 issued to Trent disclosing a pre-cast polymer concrete shell which is placed at the construction site then filled with hydraulic concrete or other ballast through filling holes on top of the shell. However, the shell cannot be placed on a retaining wall since the shell must be entirely placed on the road or bridge surface.

A method of joining pre-cast concrete barriers on substantially flat roadway surfaces is disclosed in U.S. Pat. No. 4,605,336 issued to Slaw. This design uses an upwardly projecting inverted U-shaped rod, which must be inserted into a narrow longitudinal channel, and a concrete reinforcing rod extending axially through the channel forms a longitudinal locking bar inserted to lock the barrier to the retaining wall. One problem with this design is that it can only be used on a substantially flat roadway and the alignment of the pre-cast barrier and roadway must be precise to insure that the U-shaped rods are inserted into the rectangular inserts. Another limitation is a lack of tongue and groove connection to secure the barrier in place.

SUMMARY OF THE INVENTION

A pre-cast concrete traffic barrier element comprised of a profiled inner face, a relatively unprofiled exterior face, a bottom surface having a longitudinally extending channel capable of receiving a retaining wall's top surface, upper U-shaped anchoring bars projecting from the barrier into the bottom surface's longitudinal channel, lower U-shaped anchoring bars projecting from the retaining wall's top surface into the bottom surface's longitudinal channel, an oval keyway the length of the longitudinal channel formed by the overlapping of the upper U-shaped anchoring bars and the lower U-shaped anchoring bars, and a locking bar arrangement inserted through the keyway in a locking relationship with the overlapping U-shaped anchoring bars. The barrier is held against impact by tongue and groove anchoring on a retaining wall at any height above or below grade. The disclosed traffic barrier permits the use of pre-cast concrete to form a traffic barrier for use upon a retaining wall capable of withstanding vehicular impact.

It is an object of the present invention to provide an efficient method of attaching a traffic barrier to the top face of a retaining wall without the need for direct contact between the barrier and retaining wall.

Another object of the invention is to provide a means of attaching a traffic barrier to the top face of a retaining wall without requiring precise alignment between the retaining wall and the traffic barrier.

A further object of the present invention is to provide a means of coupling pre-cast traffic barriers to a retaining wall.

Still a further object of the present invention is to provide a means of rigidly connecting a traffic barrier to a retaining wall without the need for outwardly projecting support rods.

Additional advantages, objects and uses will be apparent from the description to those familiar with the relevant art.

The foregoing objectives are achieved in a pre-cast traffic barrier reinforced with welded wire fabric which has a longitudinal channel at its base so as to allow the traffic barrier to be supported on top of a retaining wall. The traffic barrier and retaining wall have U-shaped anchoring rods meeting in an oval in the channel providing an interlocking mechanism when a locking U-shaped welded wire fabric is inserted through the oval throughout the length of the barrier.

DESCRIPTION OF THE PREFERRED EMBODIMENT

Figure 1:
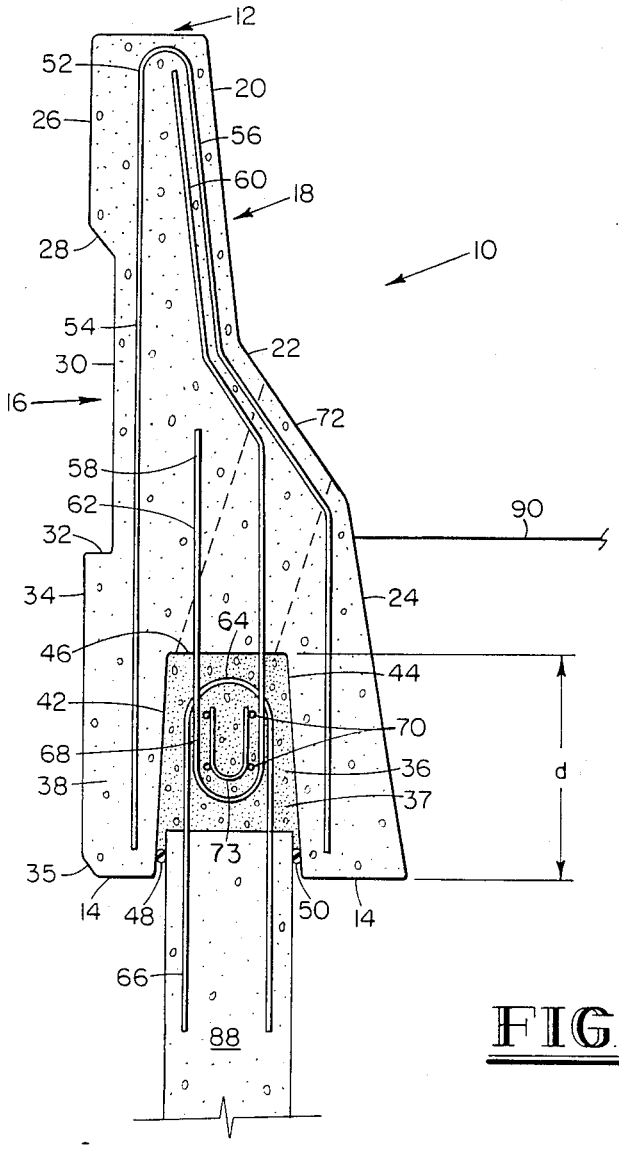
FIG. 1 is a cross-sectional view of one embodiment of a pre-cast concrete traffic barrier element constructed in accordance with this disclosure.

With Reference to FIG. 1, one embodiment of the pre-cast concrete traffic barrier element 10 according to the present invention includes an elongated block of pre-cast concrete having a top surface 12, a bottom surface 14 and two sides 16 and 18.

One side 18 preferably has a cross-sectional New Jersey profile for deflecting or redirecting a moving vehicle back towards the traffic surface 90. The New Jersey profile includes an upper inclined surface 20 extending from the top surface 12 and sloping downwardly at a first acute angle with respect to a vertical plane. An intermediate inclined surface 22 extends from the upper inclined surface 20 and slopes downwardly at a second acute angle which is greater than the first angle. A lower inclined surface 24 extends between the intermediate inclined surface 22 and the bottom surface 14. The lower inclined surface 24 slopes downwardly at a third acute angle which is less than the second angle and more than the first angle. This profile is well reported in the literature.

A relatively unprofiled side 16, opposite from the profiled side 18, provides an ornamental aspect to the traffic barrier. The relatively unprofiled side has an upper vertical surface 26 extending from the top surface 20 and sloping downward at a vertical angle. An intermediate inclined surface 28 extends from the upper vertical surface 26 and slopes downwardly at an acute angle with respect to a vertical plane. An intermediate vertical surface 30 extends from the intermediate inclined surface 28 to a horizontal surface 32. The horizontal surface 32 extends from the intermediate vertical surface 30 to the lower vertical surface 34. A lower vertical surface 34 extends from the horizontal surface 32 to the chamfer surface 35. The chamfer surface 35 extends between the lower vertical surface 34 and the bottom surface 14.

The bottom surface 14 of the pre-cast traffic barrier has a longitudinally extending channel 36 therein. The channel 36 has a significant depth d of approximately 15 inches but can vary from 4 inches to 48 inches depending on the specific requirements. Preferably, the channel 36 has a trapezoidal configuration with an internal face 46 which is parallel to the bottom surface 14. Two sidewalls 42, 44 of the channel 36 extend from the internal face 46 to the bottom surface 14. Preferably, the outer sidewall 42 diverges downwardly in a direction away from the profiled side 18 and the inner sidewall 44 diverges downwardly in an opposite direction away from the unprofiled side 16. As shown, the channel 36 is broader at the bottom for easy engagement.

The channel 36 divides the lower section of the concrete pre-cast traffic barrier into two lips 38 and 40. The outer lip 38 is defined by the concrete between the lower vertical surface 34 of the unprofiled side 16 and the outer sidewall 42 of the channel 36. The inner lip 40 is defined by the concrete between the lower inclined surface 24 of the profiled side 18 and the inner sidewall 44 of the channel 36. The two lips flank the channel 36 for the full length of the barrier.

Embedded throughout the pre-cast traffic barrier 10 is reinforcing welded wire fabric 52 to resist directly applied stresses to the pre-cast concrete traffic barrier. The welded wire fabric 52 has an outer vertical section 54 embedded within the concrete adjacent to the unprofiled side 16 and an inner section 56 embedded within the concrete adjacent to the profiled side 18. The inner section 56 follows the slopes of the profiled side 18 at the upper inclined surface 20, intermediate inclined surface 22, and also the lower inclined surface 24.

Also embedded in the concrete barrier 10 are U-shaped reinforcing anchoring rods 58 to resist applied stresses at the channel 36. The U-shape opens upwardly. An upper U-shaped anchoring rod 58 has an inner inclined section 60 embedded within the concrete adjacent to the profiled side 18 and an outer vertical section 62 embedded within the concrete adjacent to the unprofiled side 16. The upper U-shaped anchoring rod 58 extends into the channel 36 to form an eyelet cooperative with a similar eyelet 64 with a lower U-shaped anchoring rod 66. The lower U-shaped anchoring rods 66 are embedded in the retaining wall 88. This U-shape opens downwardly. Preferably, there are a plurality of upper U-shaped anchoring rods 58 and a matching plurality of lower U-shaped anchoring rods 66 spaced evenly throughout the length of the barrier. Thus, the open channel encloses alternating eyelets; FIG. 1 shows the eyelets inscribing a large area for a lock to be described.

Viewing the channel 36 prior to filling with grout, an elongate rebar lock member is inserted from the end; that is, several rebars 70 form a lock equal to the barrier in length. The rebars 70 are formed into a beam by plural, spaced U-shaped cross bars 73. The beam is inserted into the channel 36, passes through every eyelet and fastens the barrier 10 to the supporting wall 88.

Inlet fill holes 72 extend from the intermediate inclined surface 22 of the profiled side 18 to the empty channel 36. The inlet fill holes 72 are used to pump cast-in-place concrete, grout, mortar or similar material into the channel 36 to fill the channel along this length of the barrier 10. Separately installed sealing material at 48 and 50 prevent the pumped in cast-in-place concrete, grout, mortar or similar material from escaping from the channel 36 during the pumping process. The sealing material 48 and 50 ideally is impregnated asphalt board, however alternative materials, including but not limited to elastiomeric material, precompressed foam sealant or foam backup rods, may be used. The sealing material keeps the traffic barrier 10 from directly contacting the retaining wall 88.

In assembly, the traffic barrier 10 is aligned over the retaining wall 88 with reinforcing rods 58, 66 forming alternating eyelets 64 and 68 in the longitudinal channel 36. Sealing material 48 and 50 is put in place. The traffic barrier 10 is then lowered onto the sealing material 48 and 50 to form a seal between the traffic barrier 10 and the retaining wall 88. A locking beam is then inserted through the loops. The traffic barrier 10 is thus locked to the retaining wall 88. Then, a cast-in-place concrete, grout, mortar or similar material mixture is pumped through the inlet holes 72 into the channel 36. The openings at either end of the channel 36 allow the expulsion of air from the channel 36 while the cast-in-place concrete, grout, mortar or similar material mixture is pumped into the channel 36 allowing the channel to be completely filled with the mixture. It should be noted that once the concrete hardens, the strength of the joint formed by the anchoring eyelets is increased. After the concrete hardens the roadway surface 90 is built up in the conventional fashion.

Figure 2:
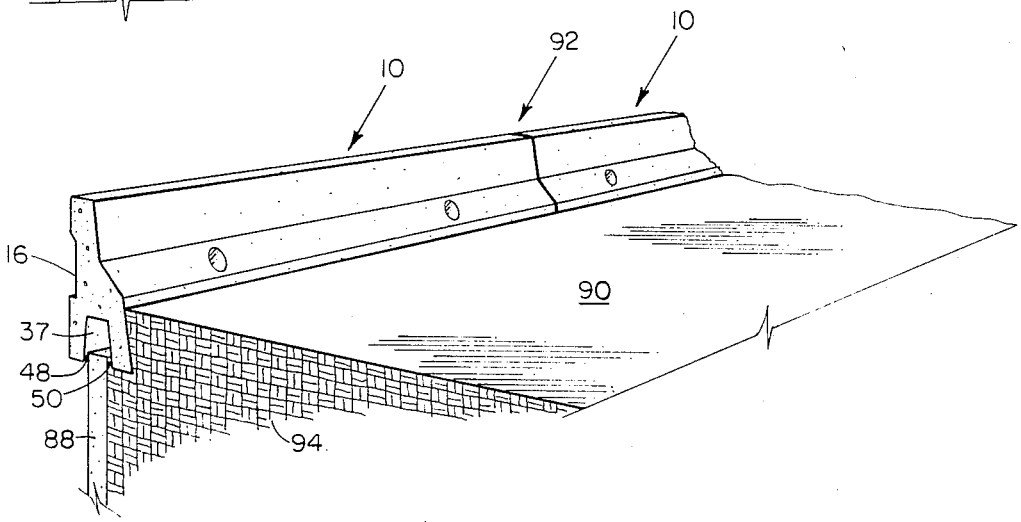
FIG. 2 is a perspective view of a roadway adjacent to a retaining wall wherein the wall barrier of FIG. 1 is safely engaged thereon.

With reference to FIG. 2, a plurality of pre-cast traffic barrier elements 10 are supported on a retaining wall 88 to form a traffic barrier 92. Each traffic barrier element 10 has a length of 10 feet but can vary from 4 feet to 40 feet depending on the specific requirements of the roadway 90 and retaining wall 88. A roadway 90 is supported by frictionally stabilized earth 94. The outer surface 16 of the traffic barrier 10 is for ornamental purposes and could be left plain or decorated with different architectural designs. The pre-cast traffic barrier 92 restrains a moving vehicle on an elevated traffic surface 90 from travelling over the edge of the wall face of the earth 94.

Figure 3:
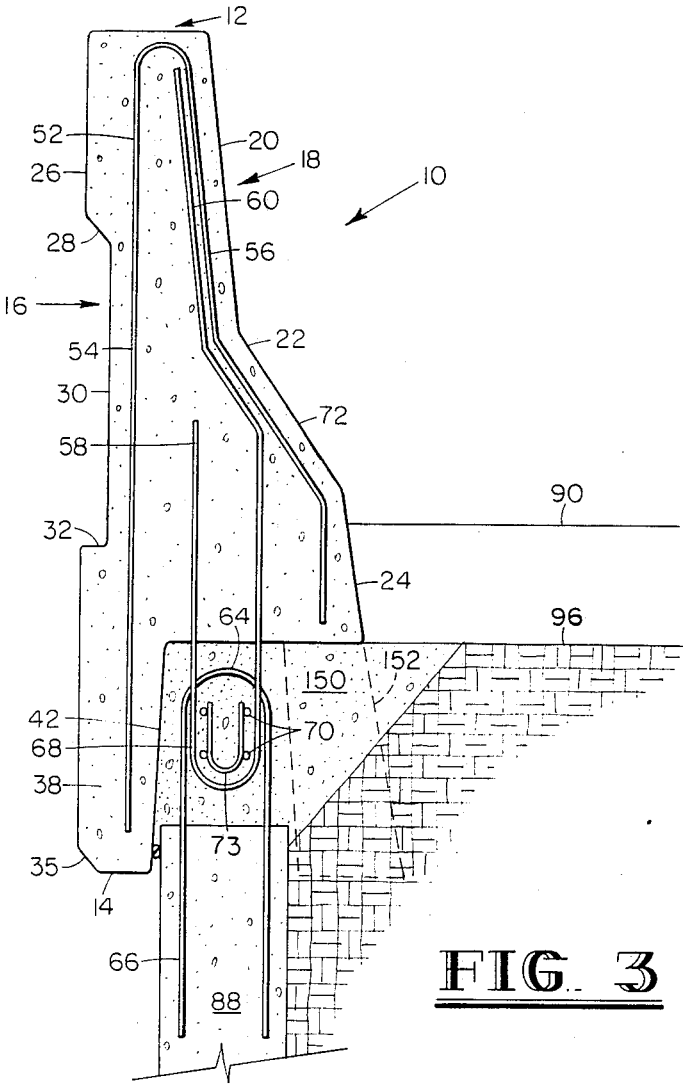
FIG. 3 is a cross-sectional view similar to FIG. 1 showing a further embodiment of a pre-cast concrete barrier element.

With reference to FIG. 3, another embodiment of the pre-cast traffic barrier 10 is cast with a longitudinal slot 150 and end sections 152. Embedded in the pre-cast traffic barrier 10 is reinforcing welded wire fabric 52 to resist directly applied stresses to the pre-cast concrete traffic barrier 10. The welded wire fabric 52 has an outer vertical section 54 embedded within the concrete adjacent to the unprofiled side 16 and an inner section 56 embedded within the concrete adjacent to the profiled side 18. The inner section 56 follows the slopes of the profiled side's 18 upper inclined surface 20, intermediate inclined surface 22, and part of the lower inclined surface 24.

Figure 4:
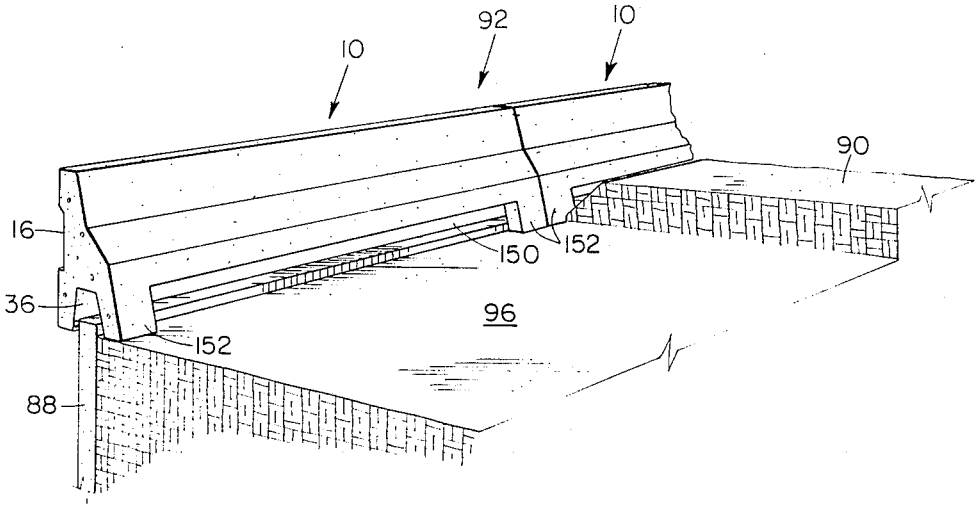
FIG. 4 is a perspective view of a roadway, with part of the roadway material removed, supported by a retaining wall having a pre-cast concrete traffic barrier embodiment as illustrated in FIG. 3.

With reference to FIG. 4, a plurality of pre-cast traffic barrier elements 10 are supported on a retaining wall 88 to form a traffic barrier 92. The roadway surface 90 is shown partially removed 96 to reveal the longitudinal slot 150. The slot 150 allows the cast-in-place concrete, grout, mortar or similar material to be pumped directly to the channel 36 encasing the interlocking anchor rods 58, 66 and locking welded wire fabric 68 of FIG. 3. The end sections 152 contain the cast-in-place concrete, grout, mortar or similar material in the channel 36 during pumping operations. The end sections 152 also balance the traffic barrier 10 during construction, keeping the traffic barrier 10 from tipping over towards the roadway surface 90.

In operation, the traffic barrier 10 is aligned over the retaining wall 88 with reinforcing rods 58, 66 forming a closed oval 64 in the longitudinal channel 36. Sealing material 48, 50 is placed over the retaining wall 88. The traffic barrier 10 is then lowered onto the sealing material 48, 50 forming a seal between the traffic barrier 10 and the retaining wall 88. A locking U-shaped welded wire fabric 68 is then inserted through the closed loop 64. The traffic barrier 10 is thus locked to the retaining wall 88 by the U-shaped welded wire fabric 68. A cast-in-place concrete, grout, mortar or similar material mixture is pumped through the longitudinal slot 150 into the channel 36. The openings at either end of the channel 36 allow the expulsion of air from the channel 36 while the cast-in-place concrete, grout, mortar or similar material mixture is pumped into the channel 36 allowing the channel to be completely filled with the mixture. It should be noted that once the cast-in-place concrete, grout, mortar or similar material mixture hardens the strength of the joint formed by the anchoring bars 58, 66 and locking welded wire fabric 68 is increased. After the cast-in-place concrete, grout, mortar or similar material mixture hardens the roadway surface 90 is built up to a point at the top of the lower inclined surface 24.

Figure 5:
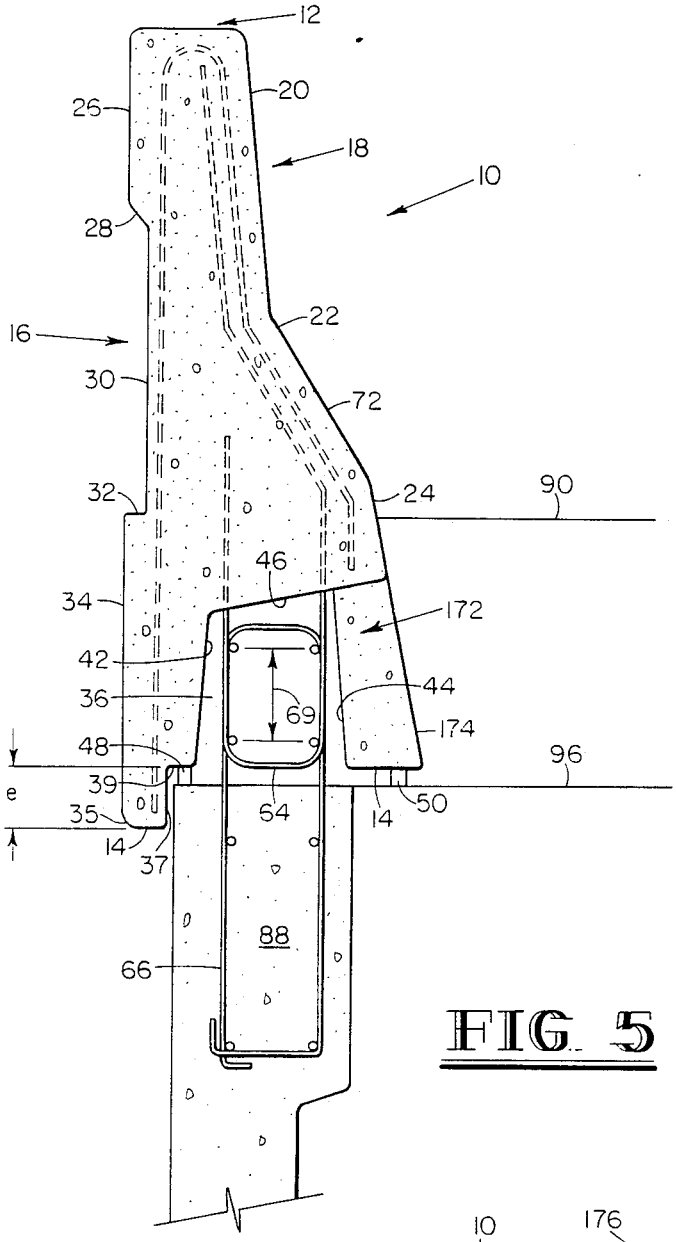
FIG. 5 is a cross-sectional view of another embodiment of a pre-cast concrete barrier element.

With reference to FIG. 5, another embodiment of the pre-cast traffic barrier 10 is cast with the chamfer surface 35 extending between the lower vertical surface 34 and the bottom surface 14. The bottom surface 14 extends from the chamfer surface 35 to an inner vertical surface 37. The inner vertical surface 37 slopes upwardly at a vertical angle to an inner horizontal surface 39. The inner vertical surface 37 extends for a length e of 3 inches, but this length e may vary from 1 inch to 24 inches. The greater the length e, the greater camming effect is created which counteracts any force applied which tends to tip the traffic barrier 10 over the retaining wall 88. Also, the greater the length e, the more adjustment is possible when aligning each barrier element 10 with the adjacent barrier elements.

The inner horizontal surface 39 slopes at a horizontal angle to the sidewall 42 of the longitudinal channel 36. The sidewall 42 slopes upwardly to an internal face 46. The internal face 46 slopes upwardly at an angle of approximately 10 degrees but can vary from 0 degrees to 70 degrees. The internal face 46 extends from sidewall 42 to sidewall 44. The sidewall 44 slopes downwardly from the internal face 46 to the bottom surface 14. The length of sidewall 44 from the inner face 46 to the bottom surface 14 is less than the length of sidewall 42 from the inner face 46 to the bottom surface 14. Sidewall 44 is shown being 4 inches longer than sidewall 42, but sidewall 44 can be cast to be from 1 inch to 36 inches longer than sidewall 42.

The longitudinal channel 36 of the pre-cast traffic barrier 10 has an upper U-shaped reinforcing anchoring rod 58 extending into the longitudinal channel 36 to form a closed oval 64 with a lower U-shaped reinforcing anchoring rod 66. Reinforcing rods 69 for interlocking the upper U-shaped anchoring rod 58 with the lower U-shaped anchoring rod 66 are inserted through the oval 64 the length of the longitudinal channel 36 to transfer stresses from the pre-cast concrete traffic barrier 10 to the retaining wall 88. The reinforcing rods 69 use 4 separate rods, one at each corner stress point of the oval 64, to transfer the stress, but can vary from 1 rod to 12 rods.

The sealing material 48, 50 supports the traffic barrier 10 and keeps the traffic barrier 10 from directly contacting the retaining wall 88. Sealing material 48 also prevents the pumped in cast-in-place concrete, grout, mortar or similar material from escaping from the longitudinal channel 36 down the retaining wall 88. The sealing material 48, 50 may also be used to shim a traffic barrier element 10 into alignment with adjacent traffic barrier elements.

Figure 6:
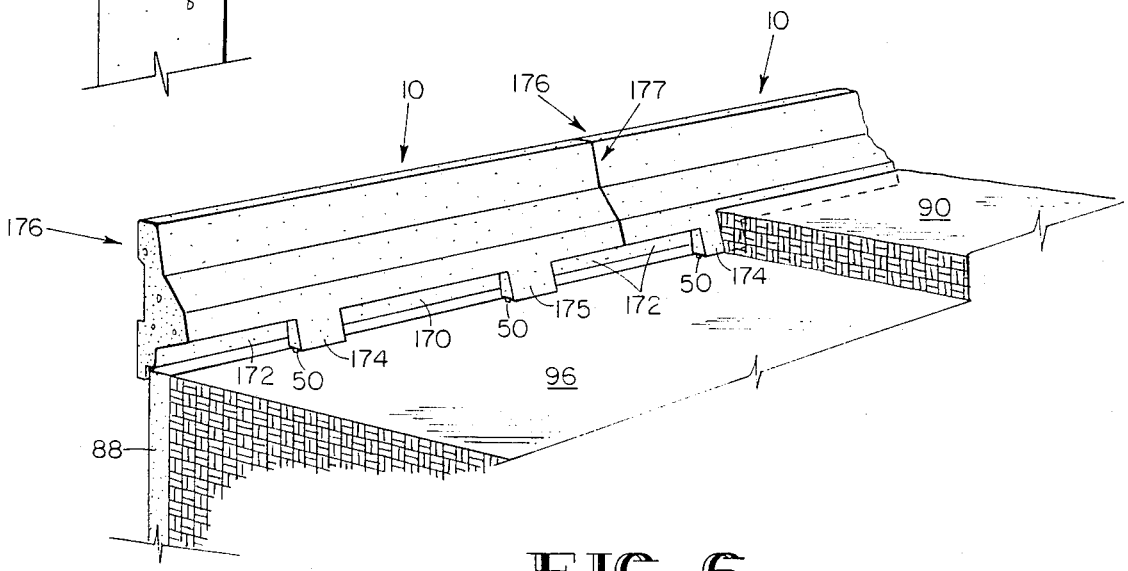
FIG. 6 is a perspective view of a roadway, with part of the roadway material removed, supported by a retaining wall having a pre-cast concrete traffic barrier illustrated in FIG. 5.

With reference to FIG. 6, a plurality of pre-cast traffic barrier elements 10 are supported on a retaining wall 88 to form a traffic barrier 92. The roadway surface 90 is shown partially removed 96 to reveal the end sections 174. The end sections 174, 175 are cast a distance of 2 feet 3¾ inches from the ends 176, 177 of the traffic barrier 10, but this distance can vary from 0 inches to 4 feet. This inset distance lessens the possibility that the end sections 174, 175 will be damaged in storage or transportation to the construction site. The end sections 174, 175 also balance the traffic barrier 10, keeping the traffic barrier from tipping over towards the graded roadway surface 91.

An inner longitudinal slot 170 extends from end section 174 to end section 175. Outer longitudinal slots 172 extend from end 176 to end section 174 and from end 177 to end section 177. The longitudinal slots 170, 172 allow cast-in-place concrete, grout, mortar or similar material to be poured into the longitudinal channel 36.

In operation, the traffic barrier 10 is aligned over the retaining wall 88 with reinforcing rods 58, 66 forming a closed oval 64 in the longitudinal channel 36. Sealing material 48, 50 is placed on the retaining wall 88 and the graded roadway surface 91 at a level flush with the top of the retaining wall 88. The traffic barrier 10 is then lowered onto the sealing material 48, 50 forming a tight seal between the traffic barrier 10 and the retaining wall 88 and graded roadway surface 91. If the plurality of traffic barriers 10 are not level with respect to each other, shims may be inserted in place of or with the sealing material 48, 50 to ensure a level alignment between the traffic barriers. Locking reinforcing rods 69 are then inserted through the closed loop 64. The traffic barrier 10 is thus locked to the retaining wall 88 by the locking reinforcing rods 69. A cast-in-place concrete, grout, mortar or similar material mixture is pumped through the longitudinal slots 170, 172 into the channel 36. The inclined internal face 46 of the channel 36 allows the expulsion of air from the channel 36 while the cast-in-place concrete, grout, mortar or similar material mixture is pumped into the channel 36, thereby allowing the channel to be completely filled with the mixture. It should be noted that once the cast-in-place concrete, grout, mortar or similar material mixture hardens the strength of the joint formed by the anchoring bars 58, 66 and locking reinforcing rods 69 is increased. After the cast-in-place concrete, grout, mortar or similar material mixture hardens the graded roadway surface 91 is built up to a point at the top of the lower inclined surface 24.

When a vehicle driving along the roadway 90 strikes the barrier 10, the profiled inner face 18 will direct the vehicle's wheel upward so as to prevent damage to the vehicle's body. This will also slow the movement of a vehicle down so that the driver will be able to regain control of his vehicle and steer it back onto the roadway 90. The force applied by the vehicle's impact would otherwise tend to tip the barrier 10 over the retaining wall 88, but this tipping force is overcome by the unique camming, interlocking eyelet arrangement, and the cemented channel features of this invention. The camming effect of the inner vertical surface 37 takes part of the tipping force and redirects it against the retaining wall 88. The interlocking bar arrangement; the upper U-shaped rods 64, the lower U-shaped rods 66, and locking bars 69, cemented in place throughout the longitudinal channel 36, takes the rest of the tipping force and absorbs it and redirects it into the retaining wall 88. This cemented locking bar arrangement and camming effect will thus allow the construction of a traffic barrier on top of a retaining wall without the need for concrete and steel anchors under the roadway surface or other external structural support. This in turn reduces the cost and time required to build a retaining wall. The tongue and groove construction avoids lateral shifting of the barricade.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that the appended claims will cover such modifications that fall within the true scope of the invention.

I claim:

1. A precast concrete traffic barrier for use as a safety device to resist the unintended passage of a vehicle over a wall structure, comprising:

A. a plurality of concrete reinforcing rods reinforcing said precast concrete traffic barrier;

B. a bottom surface having a longitudinally extending channel, said longitudinally extending channel having an outer lip, inner lips, and bottom surface;

1. said inner lips and outer lip partially supporting said precast concrete traffic barrier's weight;
2. said outer lip located on the opposite side of said longitudinally extending channel from said inner lips;
3. said inner lips are located in from each end of said precast concrete traffic barrier so as to minimize the possibility of said inner lips being damaged during transportation and construction;

C. said outer lip having:

1. a bottom surface;
2. an inner vertical surface extending down the outer edge of said wall structure;
3. an inner horizontal surface for mounting said traffic barrier onto said wall structure;

D. attachment means to couple said wall structure and precast concrete traffic barrier, comprising:
1. a plurality of first U-shaped coupling members extending from said precast concrete traffic barrier to within said longitudinal channel;
2. a plurality of second U-shaped coupling members extending from said wall structure to within said longitudinal channel;
3. an oval structure within said longitudinal channel formed by said first U-shaped coupling member and said second U-shaped coupling member;
4. a plurality of interconnected reinforcing rods positioned in a coupling relationship with said plurality of first U-shaped coupling members and said plurality of second U-shaped coupling members; and
5. concrete being placed within said longitudinally extending channel encasing said plurality of first U-shaped coupling members, said plurality of second U-shaped coupling members, and said locking member wherein said inner vertical surface of said precast concrete traffic barrier creates a camming action from said precast concrete traffic barrier to said wall structure to resist overturning forces on said precast concrete traffic barrier when said precast concrete traffic barrier is struck by a vehicle.

2. A precast, reinforced, concrete traffic barrier for use as a safety device to resist the unintended passage of a vehicle over a wall structure, comprising:
A. a side facing the traffic surface with a cross-sectional profile for redirecting an incident vehicle toward the traffic surface;
B. a side facing away from said side facing the traffic surface;
C. a bottom surface having a longitudinally extending channel, said longitudinally extending channel having a trapezoidal configuration comprising:
1. an outer lip forming an outer sidewall of said longitudinally extending channel;
2. inner lips forming an inner sidewall of said longitudinally extending channel; said inner lips are located in from each end of said precast, reinforced, concrete traffic barrier so as to minimize the possibility of said inner lips being damaged during transportation and construction;
3. an internal surface located between said inner sidewall and said outer sidewall forming an internal face of said longitudinally extending channel; and
4. said outer lip and said inner lips create a wedging action to support said traffic barrier on top of said wall structure;
D. said longitudinally extending channel having an outer lip, inner lips, and bottom surface;
E. attachment means to couple said wall structure and said precast, reinforced, concrete traffic barrier, comprising;
1. a plurality of first U-shaped coupling members extending from said precast, reinforced, concrete traffic barrier to within said longitudinal channel;
2. a plurality of second U-shaped coupling members extending from said wall structure to within said longitudinal channel;
3. an oval structure within said longitudinal channel formed by said plurality of first U-shaped coupling members and said plurality of second U-shaped coupling members;
4. a plurality of locking rods positioned in a coupling relationship with said plurality of first U-shaped coupling members and said plurality of second U-shaped coupling members; and
5. concrete being placed within said longitudinally extending channel encasing said plurality of first U-shaped coupling members, said plurality of second U-shaped coupling members, and said locking rods.

3. A traffic barrier for use adjacent a roadway having an exposed top edge of a horizontal beam, comprising:
(a) a barrier formed of at least one similar, end aligned barrier segments, each of said barrier segments including:
1. a traffic facing sidewall;
2. an internal groove along a nether face;
3. a second and opposite sidewall co-extensive with the traffic facing sidewall; and
4. a solid construction of specified strength and weight between said sidewalls;
(b) a cooperative exposed upper edge of the horizontal beam engaging said internal groove by insertion thereunto in a locking relationship;
(c) first spaced eyelet means supported by said barrier;
(d) spaced second eyelet means supported by said beam, said first and second eyelet means aligning cooperatively on forming a locking relationship with said groove and said beam edge; and
(e) lock means serially threaded through said first and second eyelet means along said barrier to fix said barrier to said beam, said lock means comprises
1. at least two parallel elongate members inserted through said first and second eyelet means and joined by at least one transverse member; and
2. cast-in-place concrete filling said groove.

4. The traffic barrier of claim 3 wherein said nether face is defined by a pair of spaced facial edge areas located in from each end of said traffic barrier so as to minimize the possibility of said spaced facial edge areas being damaged during transportation and construction.

5. A traffic barrier for use adjacent a roadway having an exposed top edge of a horizontal beam, comprising:
(a) a barrier formed of at least one similar, end aligned barrier segments, each of said barrier segments including:
1. a traffic facing sidewall;
2. an internal groove along a nether face, wherein the face is defined by a pair of spaced facial edge areas; and
3. a second and opposite sidewall co-extensive with the traffic facing sidewall;
(b) a cooperative exposed upper edge of the horizontal beam facially engaging said barrier by lengthwise contact thereagainst in a stacked relationship;
(c) first spaced eyelet means supported by said barrier;
(d) spaced second eyelet means supported by said beam, said first and second eyelet means aligning cooperatively on forming a locking relationship with said barrier and said beam edge;
(e) at least two parallel elongate members joined by at least one transverse member, said elongate members being serially threaded through all of said eyelet means; and
(f) cast-in-place concrete filling said groove.

6. The traffic barrier of claim 5 wherein said spaced facial edge areas being positioned in from each end of said barrier segments so as to minimize the possibility of said inner lips being damaged during transportation and construction.

7. A method of constructing a traffic barrier on a top edge of a wall structure having a traffic surface thereon, comprising the steps of:

said traffic barrier comprised of:

a side facing the traffic surface with a cross-sectional profile for redirecting an incident vehicle toward the traffic surface;

a side facing away from said side facing the traffic surface;

a bottom surface having a longitudinally extending channel;

said longitudinally extending channel having an outer lip, inner lips, and bottom surface;

said inner lips and outer lip are on opposite sides of said longitudinally extending channel;

said inner lips and outer lip partially supporting the traffic barrier's weight;

said outer lip comprising;

a bottom surface;

an inner vertical surface extending down the outer edge of said wall structure;

an inner horizontal surface for mounting said traffic barrier onto said wall structure; and a sidewall of said longitudinally extending channel; and attachment means to couple said wall structure and said traffic barrier, comprising;

a first U-shaped coupling member extending from said traffic barrier to within said longitudinal channel;

a second U-shaped coupling member extending from said wall structure to within said longitudinal structure;

an oval structure within said longitudinal channel formed by said first U-shaped coupling member and said second U-shaped coupling member;

grading of the roadway substructure level with said top edge of said wall structure;

positioning said traffic barrier over said top edge of said wall structure so that said longitudinally extending channel of said traffic barrier is aligned with said top edge;

placing sealing material on said top edge of said wall structure and on top of said roadway substructure adjacent to said wall structure;

lowering of said traffic barrier so that said inner horizontal surface and said inner lips support said traffic barrier;

coupling said traffic barrier and said wall structure by inserting a locking member through said oval structure; and placing concrete within said longitudinally extending channel encasing said plurality of first U-shaped coupling manner, said plurality of second U-shaped coupling member, and said locking member.

8. The method as recited in claim 7, wherein the step of lowering said traffic barrier on said wall structure includes using shims to level the connection between one traffic barrier and an adjacent traffic barrier.

* * * * *